US010278416B2

(12) United States Patent
Kindvall et al.

(10) Patent No.: US 10,278,416 B2
(45) Date of Patent: May 7, 2019

(54) FREEZE DRIED ORAL SMOKELESS TOBACCO SNUFF OR NON-TOBACCO SNUFF PRODUCT AND METHOD OF MANUFACTURING THEREOF

(71) Applicant: SWEDISH MATCH NORTH EUROPE AB, Stockholm (SE)

(72) Inventors: Mårten Kindvall, Göteborg (SE); Lars Jonsson, Göteborg (SE); Mattias Schyberg, Göteborg (SE)

(73) Assignee: Swedish Match North Europe AB, Stockholm (SE)

( * ) Notice: Subject to any disclaimer, the term of this patent is extended or adjusted under 35 U.S.C. 154(b) by 10 days.

(21) Appl. No.: 14/774,104

(22) PCT Filed: Apr. 4, 2014

(86) PCT No.: PCT/EP2014/056866
§ 371 (c)(1),
(2) Date: Sep. 9, 2015

(87) PCT Pub. No.: WO2014/166845
PCT Pub. Date: Oct. 16, 2014

(65) Prior Publication Data

US 2016/0015077 A1 Jan. 21, 2016

(30) Foreign Application Priority Data

Apr. 9, 2013 (EP) ..... 13162941

(51) Int. Cl.
*A24B 15/18* (2006.01)
*A24B 13/00* (2006.01)
*A24F 23/02* (2006.01)
*B65B 63/08* (2006.01)

(52) U.S. Cl.
CPC ..... *A24B 15/183* (2013.01); *A24B 13/00* (2013.01); *A24F 23/02* (2013.01); *B65B 63/08* (2013.01)

(58) Field of Classification Search
CPC ..... A14B 13/00; A24B 15/183; B65B 63/08
USPC ..... 131/352
See application file for complete search history.

(56) References Cited

U.S. PATENT DOCUMENTS

| | | | |
|---|---|---|---|
| 3,223,090 | A | 12/1965 | Strubel et al. |
| 3,693,629 | A | 9/1972 | Broughton |
| 4,068,671 | A | 1/1978 | Casey |
| 5,387,416 | A | 2/1995 | White et al. |
| 2008/0029110 | A1 | 2/2008 | Dube et al. |

(Continued)

OTHER PUBLICATIONS

Prokopczyk, Bogdan, et al., "Supercritical Fluid Extraction in the Determination of Tobacco-Specific N-Nitrosamines in Smokeless Tobacco," 1992, Reprinted from Chemical Research in Toxicology. Unknown. https://www.industrydocumentslibrary.ucsf.edu/tobacco/docs/gtcw0037 (Year: 1992).*

(Continued)

*Primary Examiner* — Michael H. Wilson
*Assistant Examiner* — Yana B Krinker
(74) *Attorney, Agent, or Firm* — Knobbe Martens Olson & Bear LLP

(57) ABSTRACT

A freeze dried oral smokeless tobacco snuff or non-tobacco snuff product and a method of manufacturing the freeze dried oral smokeless tobacco snuff or non-tobacco snuff product.

13 Claims, 2 Drawing Sheets

(56) References Cited

U.S. PATENT DOCUMENTS

| | | | | |
|---|---|---|---|---|
| 2013/0053603 | A1* | 2/2013 | Norstrom | A24B 13/00 564/63 |
| 2013/0152953 | A1* | 6/2013 | Mua | A24B 15/18 131/111 |

OTHER PUBLICATIONS

Hoffmann, Dietrich, et al., "Supercritical Fluid Extraction in the Determination of Tobacco-Specific N-Nitrosamines in Smokeless Tobacco," Chem. Res. Toixol. 1992, 5, 336-340, https://www.industrydocumentslibrary.ucsf.edu/tobacco/docs/zxmp0119 (Year: 1992).*

Apr. 29, 2014 Int'l Search Report from related PCT App. PCT/EP2014/056866 filed Apr. 4, 2014.

"Extract," Merriam-Webster Online Dictionary, https://www.merriam-webster.com/dictionary/extract, accessed May 4, 2018.

"Extract," Oxford Online Dictionary, https://en.oxforddictionaries.com/definition/extract, accessed May 4, 2018.

"Snuff," Merriam-Webster Online Dictionary, https://www.merriam-webster.com/dictionary/snuff, accessed May 4, 2018.

"Spray Dry," Merriam-Webster Online Dictionary, https://www.merriam-webster.com/dictionary/spray-dry, accessed May 4, 2018.

Monthly Statistical Release—Tobacco Products, https://www.ttb.gov/tobacco/tobacco-stats.shtml, Alcohol and Tobacco Tax and Trade Bureau (TTB), accessed May 4, 2018.

Anandharamakrishnan et al., *Spray Drying Techniques for Food Ingredient Encapsulation*, Chapter 1, "Introduction to Spray Drying," John Wiley & Sons, Ltd., 2015, pp. 1-36.

Andersen et al., "Effect of Storage Conditions on Nitrosated, Acylated, and Oxidized Pyridine Alkaloid Derivatives in Smokeless Tobacco Products," *Cancer Research*, 49:5895-5900, Nov. 1, 1989.

Omole et al., "Smokeless tobacco: is it really safe?" *South African Family Practice*, 51:4, 2009, pp. 292-295.

Sapkale et al., "Supercritical Fluid Extraction," *Int. J. Chem. Sci.*: 8(2), 2010, pp. 729-743.

Sloth, "Method for Improving Spray Drying Equipment and Product Properties," *International Ceramic Review*, Mar. 4, 2010, pp. 193-197.

Tambakhe et al., "Freeze Drying," University Department of Chemical Technology, Sant Gadge Baba Amravati University, Amravati, Maaharashtra, India, Mar. 27, 2014, online.

Voges, *Tobacco Encyclopedia. The Standard Reference Work for the Tobacco Industry. Tobacco Journal International*, 2000, pp. 52, 224.

* cited by examiner

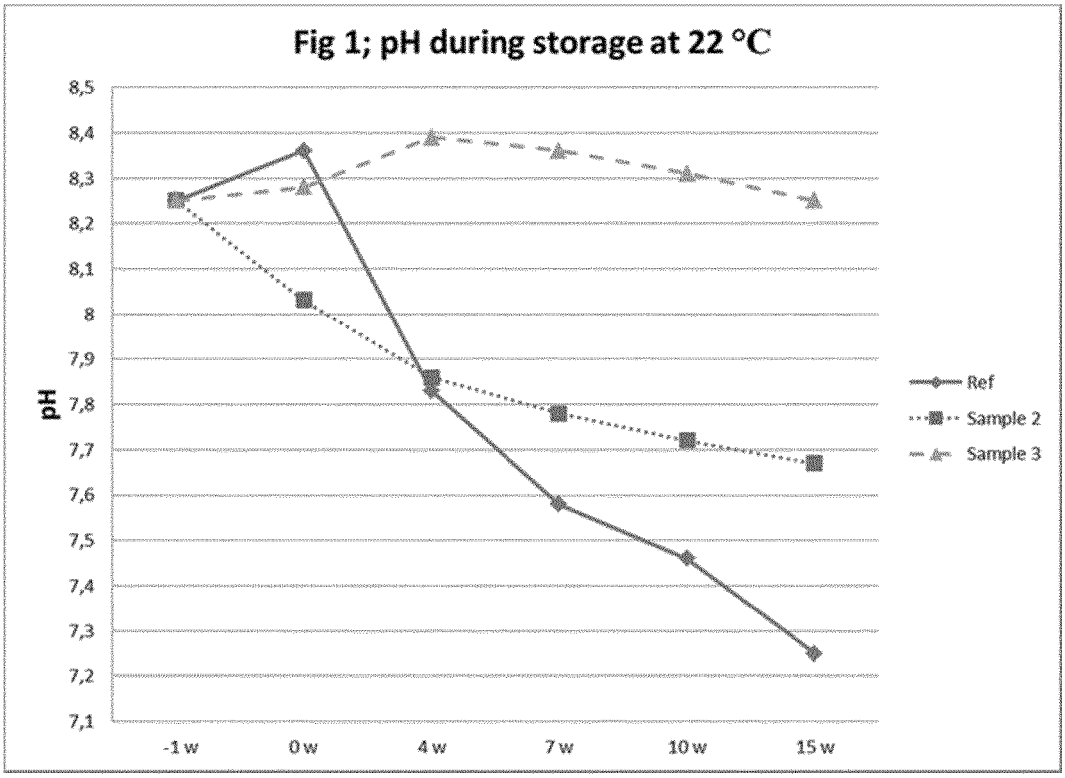
Fig 1; pH during storage at 22 °C
pH
8,5
8,4
8,3
8,2
8,1
8
7,9
7,8
7,7
7,6
7,5
7,4
7,3
7,2
7,1
-1 w
0 w
4 w
7 w
10 w
15 w
Ref
Sample 2
Sample 3
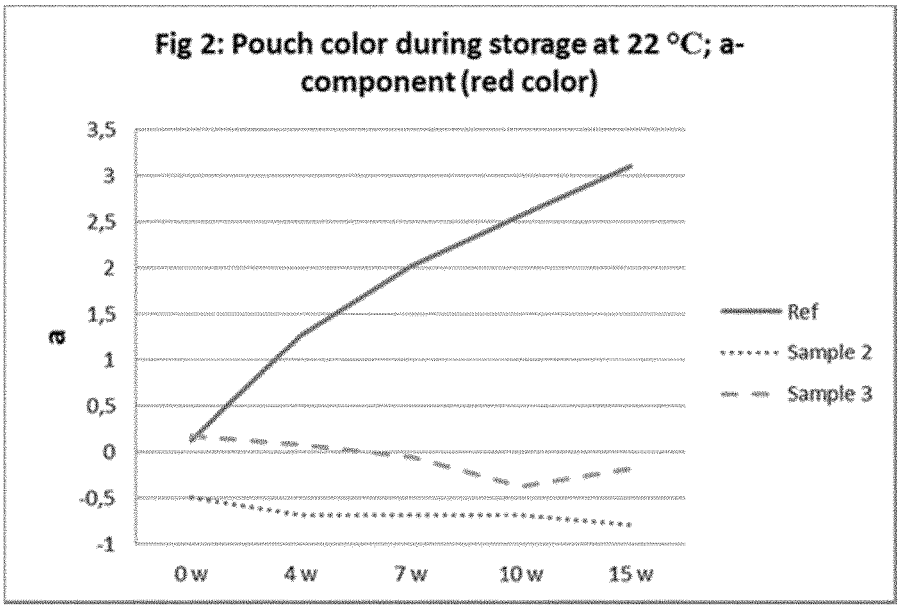
Fig 2: Pouch color during storage at 22 °C; a-component (red color)
a
3,5
3
2,5
2
1,5
1
0,5
0
-0,5
-1
0 w
4 w
7 w
10 w
15 w
Ref
Sample 2
Sample 3

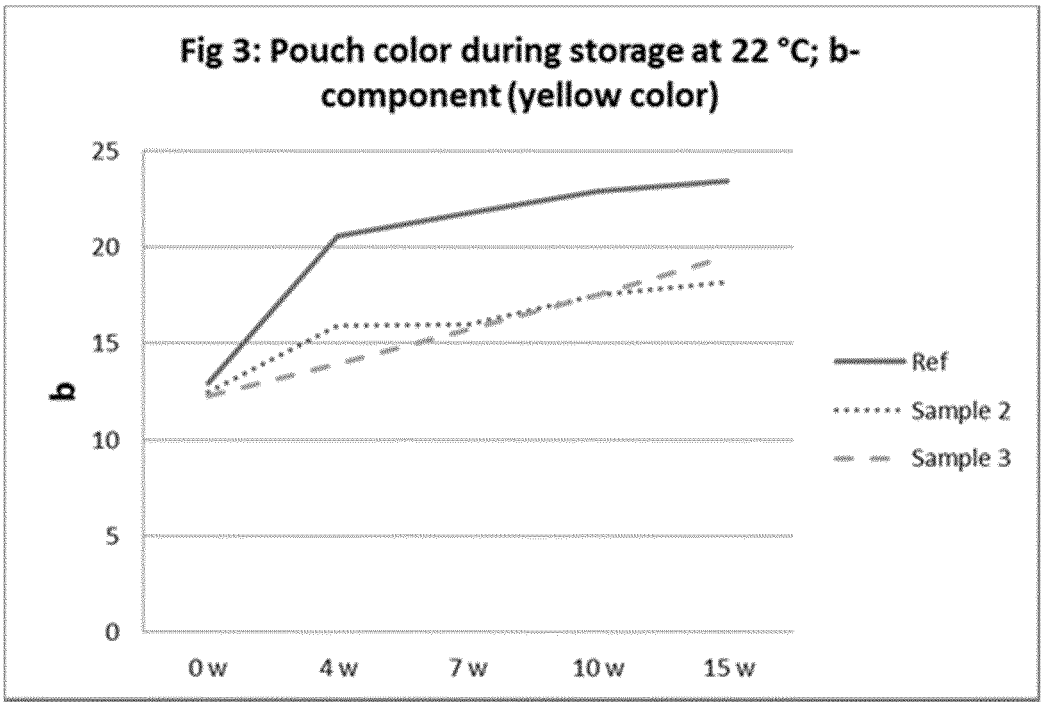
Fig 3: Pouch color during storage at 22 °C; b-component (yellow color)
b
25
20
15
10
5
0
0 w
4 w
7 w
10 w
15 w
Ref
Sample 2
Sample 3

FREEZE DRIED ORAL SMOKELESS TOBACCO SNUFF OR NON-TOBACCO SNUFF PRODUCT AND METHOD OF MANUFACTURING THEREOF

CROSS REFERENCE TO RELATED APPLICATIONS

This application is a U.S. National Phase Application of PCT International Application Number PCT/EP2014/056866, filed on Apr. 4, 2014, designating the United States of America and published in the English language, which is an International Application of and claims the benefit of priority to European Patent Application No. 13162941.2, filed on Apr. 9, 2013. The disclosures of the above-referenced applications are hereby expressly incorporated by reference in their entireties.

TECHNICAL FIELD

The present invention relates to a freeze dried oral smokeless tobacco snuff or non-tobacco snuff product and to a method of manufacturing such a product.

BACKGROUND ART

There are many various forms of smokeless tobacco for oral use. Such forms include chewing tobacco and snuff. Snuff is available in two forms, as dry snuff for oral or nasal use and moist (or wet) snuff for oral use. There are two types of moist snuff, the American and the Scandinavian type. American-type moist snuff is available in a loose form or as pre-packed pouches and is typically used between the lower gum and lip. Snus is the Scandinavian-type of moist snuff which is also available in loose form or as pre-packed portions in pouches. Snus is typically used between the upper gum and lip.

Oral smokeless non-tobacco snuff products are products, which do not contain tobacco, resembling oral smokeless tobacco snuff products and are used in the same way as oral smokeless tobacco snuff products.

Oral smokeless tobacco snuff or non-tobacco moist snuff products, such as snus, usually comprise 30 to 60 weight-% moisture. These products require refrigeration until use in order to prevent, for example, degeneration of flavour and aroma and pH instability. Therefore, their shelf life is rather limited. Moreover, a particular problem of snuff products with high moisture content is moisture migration during storage causing spotting of the pouch paper and as a consequence discoloration of the same.

There are dryer snuff products available on the market with a moisture content of about between 30 to 20 weight-%. The organoleptic properties of these semi-dry products, such as mouth feel and texture are usually inferior to those of oral smokeless tobacco moist snuff or non-tobacco moist snuff products with high moisture content. In addition, if not refrigerated during storage, their properties such as pH stability are affected and consequently, their shelf life is affected too, though to a lesser extent than products with higher moisture content.

Hence, there exists a need for oral smokeless tobacco snuff or non-tobacco snuff products that fulfil special demands such as, for example, longer shelf life, improved pH stability, while desired organoleptic properties are preserved.

SUMMARY OF THE INVENTION

The present invention provides a freeze dried oral smokeless tobacco snuff or non-tobacco snuff product and a method of manufacturing the freeze dried oral smokeless tobacco snuff or non-tobacco snuff product.

The freeze dried oral smokeless tobacco snuff or non-tobacco snuff product and the method of its manufacturing according to the present invention are defined in the appended claims.

The present invention provides an improved smokeless tobacco snuff or non-tobacco snuff product with significantly longer shelf life than that of existing moist or semi-dry oral smokeless tobacco snuff or non-tobacco snuff products, while having organoleptic properties comparable to those of existing oral smokeless tobacco moist snuff or non-tobacco moist snuff products.

The method of manufacturing the freeze dried oral smokeless tobacco snuff or non-tobacco snuff product of the invention comprises:

a) providing a mixture of tobacco or non-tobacco material, water, salt and optionally other ingredients;

b) processing said mixture; and c) freeze drying the processed mixture; and d) optionally packing the finished product, either as is or in portions, in cans or boxes.

BRIEF DESCRIPTION OF THE FIGURES

FIG. 1: Graph showing pH stability of smokeless tobacco snuff products over time. Products tested were one freeze dried product according to the present invention and two reference products, one with a 55 weight-% moisture content and one with low moisture content about 15 weight-% (dried with conventional means).

FIGS. 2 and 3: Graphs showing colour stability of pouch paper of smokeless tobacco snuff products over time. Products tested were one freeze dried product according to the present invention and two reference products, one with 55 weight-% moisture content and one with low moisture content about 15 weight-% (dried with conventional means).

DETAILED DESCRIPTION

By "freeze dried snuff" is meant herein an oral smokeless tobacco snuff or non-tobacco snuff product that has first been prepared according to any known snuff manufacturing process in the art, such as, e.g., those described herein below and then afterwards has been freeze dried according to any known freeze drying process, wherein the moist snuff product is first frozen and thereafter moisture is removed from the product at a temperature below that of the freezing point of water by applying a reduced air pressure, under which the frozen moisture in the product sublimes directly from the solid phase to the gas phase.

"Snus", which is the Swedish term for oral snuff, is used herein as a description for an oral tobacco snuff or non-tobacco snuff product produced in a heat-treatment process instead of by fermentation. The product may be provided in particulate form, as a loose powder, or portion packed in a pouch. "Particulate" is used herein for a particle size of the product which enables the final product to be provided in so-called loose form, from which a pinch of snus may be made in individual sizes by the person using the product. The final water content is typically higher than 40 wt %, but semi-dry products having less than 40 wt % water content are also available. Snus is typically used between the upper gum and lip.

The term "moisture content" as used herein may include water, humectants, liquid additives such as flavourants, and/or other liquid compounds or compositions of compounds. The moisture content in the product can, e.g., be calculated according to the method described in AOAC, Official Methods of Analysis, Vol. 1, Chapter 3, p. 64 (1990, 15th edition) or that described in Federal Register, Vol 74, No. 4 Jul. 1, 2009/Notices, page 716, Chapter III.

As used herein, the terms "flavour" and "flavourant" refer to a substance used to influence the aroma and/or taste of the smokeless tobacco snuff or non-tobacco snuff product, including, but not limited to, essential oils, single flavour compounds, compounded flavourings, and extracts. They may be in any form, for example, oil, liquid, or powder.

As used herein, "organoleptic" refers to relating or contributing to the integrated sensory perception by the consumer that includes, for example, any combination of aroma, fragrance, flavour, taste, odour, texture, mouth feel, or the like.

As used herein, the terms "unstable pH" and "pH instability" refer to the natural process of decreasing pH which is exhibited by all moist snuff products during storage. The decreased pH is a result of on-going chemical processes in the moist tobacco or non-tobacco composition, processes that cause neutralization of the pH regulator, such as a base, for example, sodium carbonate, added to the product during manufacturing.

The freeze dried product of the invention may have a moisture content of less than about 20 weight-%, less than about 15 weight-%, less than about 10 weight-%, less than about 9 weight-%, less than about 8 weight-%, less than about 7 weight-%, less than about 6 weight-%, less than about 5 weight-%, less than about 4 weight-%, less than about 3 weight-%, or less than about 2 weight-%. Expressed in intervals the freeze dried product of the invention may have a moisture content of about between 0 to less than 20 weight-%, 2 to less than about 15 weight-%, 2 to 10 weight-%, 2 to 9 weight-%, 2 to 8 weight-%, or 2 to 7 weight-%.

The freeze dried product of the invention can be stored at room temperature without refrigeration, while the product properties are preserved. Preservation is possible because the greatly reduced moisture content inhibits the processes that would normally spoil or degrade the product. In addition, the organoleptic properties of the freeze dried product of the invention upon use are comparable to those of existing oral smokeless tobacco moist snuff or non-tobacco moist snuff products.

The present invention provides a freeze dried oral smokeless tobacco snuff or non-tobacco snuff product with a significantly improved pH stability during storage as compared to the existing moist or semi-dry oral smokeless tobacco snuff or non-tobacco snuff products.

The present invention further provides a freeze dried oral smokeless tobacco snuff or non-tobacco snuff product in the form of pouches or sachets where spotting of the wrapping material of the pouch or sachet during storage is eliminated.

The organoleptic properties of the smokeless tobacco snuff or non-tobacco snuff product of the invention upon re-moisturizing are superior to those of existing semi-dry smokeless tobacco snuff or non-tobacco snuff products. The freeze-dried product of the invention can be re-moisturized much more quickly and easily as compared to that of conventionally dry or semi-dry oral smokeless products, because the freeze drying process leaves microscopic pores. The pores are created by the ice crystals that sublimate, leaving gaps or pores in their place. Thus, the product of the invention, regains the organoleptic properties it possessed prior to freeze drying when re-moisturized prior to or during use.

Accordingly, freeze-drying increases the shelf life of freeze dried oral smokeless tobacco snuff or non-tobacco snuff products significantly even for many years, while preserving the organoleptic properties of the products.

The freeze dried product of the invention may be re-moisturized by the end user either prior to use or in the mouth during use. Re-moisturizing before use may be obtained by addition of a liquid onto the freeze dried oral smokeless tobacco snuff or non-tobacco snuff product. This may be done, for example, by using a pipette in case of a product in a loose, particulate form, or by dipping in a liquid in case of a product in the form of a pouch. Suitable liquids may include water, any alcoholic drink, such as whisky, rum or gin, coffee or tea, or any soft drink such as soda, Coca-Cola or any kind of fruit juice.

Manufacturing processes of oral smokeless tobacco snuff products are well known to the person skilled in the art, and any known process thereof may be used. Moist snuff is known as either Swedish-type snus or American-type moist snuff. A general description of snus manufacturing is presented by e.g. ESTOC, European Smokeless Tobacco Council, and the GothiaTek® quality standard for snus. Methods for the manufacture of American type moist snuff and chewing tobacco are described in e.g. 'Wahlberg, I., Ringberger, T. (1999) Smokeless Tobacco. In: Tobacco: *Production, Chemistry and Technology*, (eds D. L. Davis & M. T. Nielsen) pp. 452-460. World Agriculture Series, Blackwell Science Ltd. Tobacco is the raw material in any oral smokeless tobacco snuff product.

The principle of snus manufacturing is to mix ground or cut tobacco with water and sodium chloride and heat treating the mixture for a period of time long enough, typically several hours, and at a temperature high enough, to meet the demands for pasteurization. The heat treatment also gives texture and colour to the mixture and enhances the natural tobacco flavours. After heat treatment the mixture is chilled. Additives such as pH-regulators and flavourings are then added and the mixture may be adjusted in water content. The ready-made blend is packed, typically in cans or boxes as loose snus or as portions (pouches or sachets).

American-type moist snuff is commonly produced through a fermentation process of moisturized ground or cut tobacco. Flavours and ingredients are mixed to the blend and water is added to adjust the moisture content. American-type moist snuff is available in a loose form or as pre-packed pouches.

Manufacturing of oral smokeless non-tobacco snuff products may be adapted to follow the procedure of manufacturing of oral smokeless tobacco snuff products, where tobacco is replaced by non-tobacco raw material, typically constituted of non-tobacco fibres originated from plant materials. Suitable non-tobacco fibres are plant fibres having high dietary fibre content. Examples of such materials are oat fibres (dietary fibre content>85%), apple fibres (dietary fibre content approx. 50-60%), sugar beet fibres (dietary fibre content approx. 65-75%), potato fibres (dietary fibre content approx. 70%), corn fibres (dietary fibre content approx. 70-80%), buckwheat fibres (dietary fibre content approx. 90%), cocoa fibres (dietary fibre content approx. 50%), cellulose fibres (dietary fibre approx. 95-99%). Oral smokeless non-tobacco snuff products are used in the same manner as the corresponding oral smokeless tobacco snuff products. They offer a healthier alternative to oral smokeless tobacco snuff products, since they do not contain tobacco and usually do not contain any nicotine either.

The smokeless tobacco snuff or non-tobacco snuff product according to the present invention may be manufactured according to the GothiaTek® standard.

Following the procedure of GothiaTek® standard implies hygienic handling of all ingredients and pasteurization of the loaded materials and assures a final composition with negligible levels of bacteria.

According to an embodiment of the present invention the method comprises a heat treatment. The heat treatment may be a pasteurization process. The temperature during the pasteurization process may be held at about 70-100° C. during approximately 1 to 30 hours, or approximately 10 hours.

According to another embodiment the method comprises a cooling step, wherein the temperature of the blend is cooled down to 15-30° C., preferably approx. 20° C., during 0.5 to 2 hours of applied cooling while stirring.

According to yet another embodiment the manufacturing method is kept in a closed system and handling of all ingredients complies with food safety regulations.

Freeze Drying

Generally freeze-drying works by first freezing a material and then reducing the surrounding pressure to allow the frozen water/moisture in the material to sublimate directly from the solid phase to the gas phase.

A complete freeze drying process may include three stages such as freezing, primary drying, and if needed, secondary drying.

Freezing

On a larger scale, freezing is usually done using a freeze-drying machine. In this step, it is important to cool the material below its triple point, the lowest temperature at which the solid and liquid phases of the material can coexist. This ensures that sublimation rather than melting will occur in the following steps. Larger crystals are easier to freeze-dry. To produce larger crystals, the product should be frozen slowly or be cycled up and down in temperature. Usually, the freezing temperatures are between −50° C. and −80° C. In a lab the freezing temperature may be higher, e.g., such as between −15° C. and −80. The freezing phase is the most critical in the whole freeze-drying process, because the product may be spoiled if badly done.

Primary Drying

During the primary drying phase, the pressure is lowered (to the range of a few millibars), and enough heat is supplied to the material for the moisture to sublime. The amount of heat necessary can be calculated using the sublimating molecules' latent heat of sublimation. In this initial drying phase, about 95% of the moisture in the material is sublimated. In this phase, pressure is controlled through the application of partial vacuum. The vacuum speeds up the sublimation, making it useful as a deliberate drying process. Furthermore, a cold condenser chamber and/or condenser plates provide a surface(s) for the water vapour to re-solidify on. This condenser plays no role in keeping the material frozen; rather, it prevents water vapour from reaching the vacuum pump, which could degrade the pump's performance. Condenser temperatures are typically below −50° C.

It is important to note that, in this range of pressure, the heat is brought mainly by conduction or radiation; the convection effect is negligible, due to the low air density.

Secondary Drying

The secondary drying phase aims to remove unfrozen water/moisture molecules, since the ice was removed in the primary drying phase. This part of the freeze-drying process is governed by the material's adsorption isotherms. In this phase, the temperature is raised higher than in the primary drying phase, and can even be above 0° C., to break any physico-chemical interactions that have formed between the water molecules and the frozen material. Usually the pressure is also lowered in this stage to encourage desorption (typically in the range of microbars, or fractions of a Pascal).

After the freeze-drying process is complete, the vacuum may be broken with an inert gas, such as nitrogen, or with ambient air, before the material is sealed.

At the end of the operation, the final residual water/moisture content in the product may be as low as around 1 to 4 weight-%.

Freeze-Drying Equipment

There are essentially three categories of freeze-dryers: the manifold freeze-dryer, the rotary freeze-dryer and the tray style freeze-dryer. Two components are common to all types of freeze-dryers: a vacuum pump to reduce the ambient gas pressure in a vessel containing the substance to be dried and a condenser to remove the moisture by condensation on a surface cooled to −40 to −80° C. The manifold, rotary and tray type freeze-dryers differ in the method by which the dried substance is interfaced with a condenser. In manifold freeze-dryers a short usually circular tube is used to connect multiple containers with the dried product to a condenser. The rotary and tray freeze-dryers have a single large reservoir for the dried substance.

Any known freeze drying technique and freeze drying equipment may be used to freeze dry the product of the invention, as long as the desired properties, such as, e.g., the organoleptic properties, of the end product remain intact/do not deteriorate.

The oral smokeless tobacco snuff or non-tobacco snuff product of the invention may be freeze dried before packaging or after packaging. Thus, steps c) and d) in the independent method claim may occur in any order.

The oral smokeless tobacco snuff or non-tobacco snuff product of the invention may be freeze dried, either in its loose, particulate form, or portioned packed in pouches or sachets. Freeze drying is conducted until desired moisture content in the product is obtained.

Freeze drying of the smokeless tobacco snuff or non-tobacco snuff product of the invention may be performed in its loose, particulate form. The loose moist snuff product is then placed in the freeze drier, where freeze drying is conducted until desired moisture content is achieved. The obtained freeze-dried product may either be packed in cans or boxes as is, or be portion formed into pouches or sachets, which subsequently may be packed in cans or boxes.

In another embodiment freeze drying of the smokeless tobacco snuff or non-tobacco snuff product of the invention may be performed after it has been packed in cans or boxes in its loose, particulate form. The loose moist snuff product in cans or boxes is then placed in the freeze drier, where freeze drying is conducted until desired moisture content is obtained.

In another embodiment the smokeless tobacco snuff or non-tobacco snuff product of the invention may be freeze dried after it has been portion formed into pouches or sachets. The pouches or sachets are then placed in the freeze drier, where freeze drying is conducted until desired moisture content is achieved. The freeze dried pouches or sachets may then be packed into cans or boxes.

The smokeless tobacco snuff or non-tobacco snuff product of the invention may optionally be flavoured. The flavouring may be performed by adding one or more flavour substances to the product. The flavouring may be done prior to or after the freeze-drying process.

In an embodiment the product of the invention may be flavoured prior to freeze drying. The flavoured moist snuff product, in its loose, particulate form or portion formed into pouches or sachets, is then placed in the freeze drier, where freeze drying is conducted until desired moisture content is obtained. In this case, i.e., when flavours are added to the product prior to freeze drying, the risk of evaporation of flavour substances during freeze-drying should be considered when choosing flavour substances.

Flavouring after freeze drying may be done either on freeze-dried product in loose, particulate form or on freeze-dried product portion formed into pouches or sachets.

Flavouring of freeze dried product in loose, particulate form may be performed by mixing the freeze dried product with one or more flavour substances. The loose flavoured freeze dried snuff product may then either be packed in cans or boxes as is, or portion formed into pouches or sachets first and then packed in cans or boxes.

Flavouring of freeze dried product in form of pouches or sachets may be performed by spraying a flavour solution onto the pouches. It may also be performed by dipping the pouches in a flavour solution, or by injecting a flavour solution into the pouches.

In another embodiment of the invention the oral smokeless tobacco snuff or non-tobacco snuff product of the invention may be flavoured by the end user.

In the case of a product in its loose, particulate form, this may be performed by applying a liquid onto the product. The liquid may, for example, be a flavour solution, any alcoholic drink, any soft drink or any beverage such as coffee or tea. The flavouring by the end user may also be performed by the use of a flavour capsule, the content of which is then applied on the product.

In the case of a product in form of pouches or sachets, the flavouring by the end user may be performed by dipping the product into a liquid. The flavouring by the end user may also be performed by applying a liquid onto the product. The liquid may, for example, be a flavour solution, any alcoholic drink, any soft drink or any beverage such as coffee or tea. The flavouring by the end user may also be performed by the use of a flavour capsule, the content of which is then applied on the product.

The invention is further illustrated by means of the following non-limiting examples. Parts and percentages relate to parts by weight and percent by weight, respectively, unless otherwise stated.

EXAMPLES

Example 1

1500 g snus was produced in accordance with GothiaTek® standard. A mixture of ground tobacco, sodium chloride and water was heat treated at a temperature of 100° C. for 2 hours and thereafter at a declining temperature of 100-70 C for 8 hours, reaching a water content of about 36%. After the heat-treatment, the mixture was chilled to about 20° C. and sodium carbonate was added to adjust the mixture to an alkaline pH of about 8.3 and water was added to adjust the moisture content to about 56%. The resulting snus had a moisture content of 55.7% and a pH value of 8.25. The snus was flavoured with a standard General flavour profile. The snus was then formed into pouches of approximately 1 g each, using a SM NYPS machine (U.S. Pat. No. 6,135,120, "Device for packing of finely divided, moistened tobacco material", Lofman et al.). Standard viscose based non-woven fabric for snus was used as wrapping material for the snus portions.

After storage at 4° C. for one week the pouches were divided into three samples.

One sample (Ref) was left unchanged with a moisture content of 55%, and served as a reference sample.

The second sample (Sample 2) was dried in a conventional convection oven at a temperature of 60° C. until the moisture content was 15%.

The third sample (Sample 3) was freeze dried according to the following procedure:

The sample was frozen overnight in a freezer set at −18° C. The sample was then transferred to a lab scale freeze dryer (Leybold Vacuum LYOVAC GT2), in which the pressure was lowered to 0.06 mbar to allow sublimation of moisture to take place. This was conducted until the moisture content of the sample was 6%.

All three samples were subsequently stored, packed in sealed plastic bags at 22° C. in controlled ambient humidity of 80% RH for 15 weeks. After 0, 4, 7, 10 and 15 weeks storage, samples were collected for analyses of:

- Moisture content: A snus sample weighing approximately 2.5 g was placed on a scale equipped with a drying facility (Mettler Toledo HB43 Halogen). The exact weight before drying ($w_b$) was recorded. The sample was thereafter dried on the scale at a temperature of 105° C. until its weight was no longer reduced (approximately 5-20 min depending on moisture content at the start). Thereafter the exact weight after drying ($w_a$) was recorded. The moisture content (MC) of the sample was calculated using the formula $MC=(w_b-w_a)/w_b$. The results obtained by this method are eqvivalent to those that would have be obtained, if the moisture method described in the AOAC or the Federal Register referred herein above should have been used instead.
- pH: was measured in a solution prepared by dissolving 5 g snus into 100 ml deionised water, using a Radiometer PHM93 Reference pH meter.
- Pouch colour: Reflective L*a*b analysis (CIE 1976 (L*, a*, b*) colour space), using a Konica Minolta Spectrophotometer CM-2500c set at illumination D65. This method measures discoloration of snuff pouches by analysing the light reflected by the pouch paper when it is lit by a standardised light source. Discolouration of white snuff pouches can be observed by the eye, at first as a slight yellowing of the paper. As discoloration proceeds, this slight yellowing deepens into a more obvious brown-yellow colour. When analysed with an L*a*b spectrophotometer, this yellowing of the pouch paper is translated into increased positive values of the green/red colour scale (a) and the yellow/blue colour scale (b). Increased values of a and b with this method is an indication of a more brown-yellow pouch paper.

FIG. 1 shows the measured pH value of all samples, i.e., Reference, Sample 2 (conventionally dried) and sample 3 according to the invention (freeze dried), measured at different time points. At the end of the manufacturing process of the snus according to example 1, all samples had the same start pH value of 8.25 (−1 w). At week 0, i.e., one week after manufacturing of the snus and at the time the drying of Sample 2 and 3 took place, Sample 2 showed already a pH decrease by 0.2 pH units during drying, while the Reference and Sample 3 according to the invention, showed a rather stable pH with a slight rising. This shows that conventional drying impacts negatively on the pH of the snuff sample, i.e., the pH decreases during conventional drying, whereas freeze drying does not affect the pH of the snuff sample during freeze drying. During storage (week 0-15), Sample 3 according to the invention showed a very good pH stability with only a pH reduction of mere 0.03 units/15 weeks, which is almost insignificant and thus, the pH stability of the sample according to the invention may be considered as unaffected. At the same time, the pH of the Reference and Sample 2 showed an pH reduction of 1.11 units/15 weeks and 0.36 units/15 weeks, respectively. Thus, from the obtained results it is apparent that the freeze dried oral smokeless tobacco snuff of the invention (Sample 3) shows significantly improved pH stability as compared to the Reference and Sample 2. Further, the obtained results show that the colour stability of a freeze dried oral smokeless tobacco snuff product pouch according to the present invention (Sample 3) is better than that of a reference product with high moisture content (Ref). Component a (red colour) increased during storage for Ref, while it decreased for Sample 3 (shown in FIG. 2). Component b (yellow colour) increased much faster for Ref than for Sample 3 (shown in FIG. 3). Samples 2 and 3 showed similar colour stability behaviour.

Example 2

500 g snus was produced in accordance with GothiaTek® standard. A mixture of ground tobacco, sodium chloride, glycerol, and water was heat treated at a temperature of 100° C. for 2 hours and thereafter at a declining temperature of 100-70° C. for 8 hours, reaching a moisture content of about 48%. After the heat-treatment, the mixture was chilled to about 20° C. and sodium carbonate was added to adjust the mixture to an alkaline pH of about 8.4 and water was added to adjust the moisture content to about 58%. The resulting snus had a moisture content of 58.2 weight-% and a pH of 8.31. The snus sample was frozen overnight in a freezer set at −18° C. The sample was then transferred to a lab scale freeze dryer (Leybold Vacuum LYOVAC GT2), in which the pressure was lowered to 0.06 mbar to allow sublimation of moisture to take place. This was conducted until the moisture content of the sample was 9 weight-%.

The freeze-dried loose snus was then divided into two samples (sample A and B). One was flavoured with a standard General flavour profile.

The flavoured loose snus (sample A) was then divided into two subsamples (sample A1 and A2). Sample A1 was formed into pouches by hand in the lab. Standard viscose based non-woven fabric for snus was used as wrapping material for the snus portions. Sample A2 was packed as is into cans by hand in the lab.

The unflavoured snus sample (sample B) was formed into pouches by hand in the lab. Standard viscose based non-woven fabric for snus was used as wrapping material for the snus portions. These pouches where then divided into two subsamples (samples B1 and B2). Sample B1 was flavoured with a standard General flavour profile by applying a flavour solution onto the pouches. Sample B2 was left unflavoured.

All samples were tested by a sensory panel, using several principles of re-moisturizing; by inserting directly into the mouth, by adding water to the samples, or by dipping the samples into different beverages prior to use.

All of the products tested by the sensory panel, where different re-moisturizing principles were used, were found to fulfil the desired organoleptic properties. However, of all, by the sensory panel, tested principles of re-moisturizing, the one found to give the best snus experience was re-moisturization prior to use, by dipping an unflavoured pouch, which comprised snus that had been freeze-dried prior to being formed into a pouch, into different beverages.

Various embodiments of the present invention have been described above but a person skilled in the art realizes further minor alterations, which would fall into the scope of the present invention. The breadth and scope of the present invention should not be limited by any of the above-described exemplary embodiments, but should be defined only in accordance with the following claims and their equivalents. Other aspects, advantages and modifications within the scope of the invention will be apparent to those skilled in the art to which the invention pertains.

The invention claimed is:

1. An oral smokeless tobacco snuff or non-tobacco snuff product comprising freeze dried snuff, wherein the oral smokeless tobacco snuff or non-tobacco snuff product has a moisture content of less than 15% by weight, wherein the freeze dried snuff comprises tobacco or non-tobacco plant fiber material, and wherein the oral smokeless tobacco or non-tobacco snuff product is incorporated into a pouch.

2. The product according to claim 1, wherein the product has a moisture content of less than 10% by weight.

3. The product according to claim 1, wherein the product has a moisture content of less than 8% by weight.

4. The product according to claim 1, wherein the product is moisturized either prior to use or in the mouth during use.

5. The product according to claim 1, wherein the freeze dried snuff comprises snus that has been freeze dried.

6. A method of manufacturing an oral smokeless tobacco snuff or non-tobacco snuff product comprising freeze dried snuff, wherein the oral smokeless tobacco snuff or non-tobacco snuff product has a moisture content of less than 15% by weight, wherein the freeze dried snuff comprises tobacco or non-tobacco plant fiber material, and wherein the oral smokeless tobacco or non-tobacco snuff product is incorporated into a pouch, comprising: a) providing a mixture comprising tobacco and/or non-tobacco plant fiber material and water; b) processing said mixture to create a processed mixture; and c) freeze drying the processed mixture.

7. The method according to claim 6, wherein the processing of the mixture comprises heat treatment.

8. The method according to claim 7, wherein the heat treatment is a pasteurization process.

9. The method according to claim 6, wherein the freeze dried oral smokeless tobacco snuff or non-tobacco snuff product is formed into portions prior to freeze drying and the oral smokeless tobacco snuff or non-tobacco snuff is thereafter freeze dried in the pouches.

10. The method according to claim 6, wherein the method further comprises adding one or more flavorants to the oral smokeless tobacco snuff or non-tobacco snuff product.

11. The method according to claim 10, wherein the one or more flavorants is added to the oral smokeless tobacco snuff or non-tobacco snuff product after freeze drying.

12. The product according to claim 1, wherein the freeze dried snuff comprises ground or cut tobacco.

13. The oral smokeless tobacco snuff or non-tobacco snuff product of claim 1, further comprising a flavouring.

* * * * *